US008409030B2

(12) United States Patent
Hoffman et al.

(10) Patent No.: US 8,409,030 B2
(45) **Date of Patent: *Apr. 2, 2013**

(54) GOLF CLUB HEAD HAVING RIBS

(75) Inventors: Joseph Henry Hoffman, Carlsbad, CA (US); Matthew David Johnson, Carlsbad, CA (US); Joshua J. Dipert, La Jolla, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/466,972

(22) Filed: May 8, 2012

(65) Prior Publication Data

US 2012/0220389 A1 Aug. 30, 2012

Related U.S. Application Data

(63) Continuation of application No. 13/020,753, filed on Feb. 3, 2011, now Pat. No. 8,172,700, which is a continuation of application No. 12/620,486, filed on Nov. 17, 2009, now Pat. No. 7,887,433, which is a continuation of application No. 11/565,485, filed on Nov. 30, 2006, now Pat. No. 7,641,568.

(51) Int. Cl.
*A63B 53/04* (2006.01)

(52) U.S. Cl. ..... 473/332; 473/345; 473/346

(58) Field of Classification Search ..... 473/324–350
See application file for complete search history.

(56) References Cited

U.S. PATENT DOCUMENTS

| | | | |
|---|---|---|---|
| 1,669,482 | A | 5/1928 | Miller |
| 2,088,095 | A | 7/1937 | Sargent et al. |
| D185,717 | S | 7/1959 | Newton |
| 3,730,529 | A | 5/1973 | Donofrio |
| 3,830,503 | A | 8/1974 | Consoli |
| D240,748 | S | 7/1976 | Bock |
| 3,997,170 | A | 12/1976 | Goldberg |
| 4,065,133 | A | 12/1977 | Gordos |
| 4,214,754 | A | 7/1980 | Zebelean |
| D257,873 | S | 1/1981 | MacDougall |
| 4,332,388 | A | 6/1982 | Crow |
| 4,431,192 | A | 2/1984 | Stuff, Jr. |
| 4,432,549 | A | 2/1984 | Zebelean |
| 4,838,555 | A | 6/1989 | Kobayashi |
| 4,900,029 | A | 2/1990 | Sinclair |
| 5,067,715 | A | 11/1991 | Schmidt et al. |
| 5,092,599 | A | 3/1992 | Okumoto |
| 5,141,230 | A | 8/1992 | Antonious |
| 5,193,810 | A | 3/1993 | Antonious |
| 5,213,328 | A | 5/1993 | Long et al. |
| 5,221,086 | A | 6/1993 | Antonious |

(Continued)

FOREIGN PATENT DOCUMENTS

| | | | |
|---|---|---|---|
| JP | 04 327864 | A | 11/1992 |
| JP | 10 295859 | A | 11/1998 |

OTHER PUBLICATIONS

Cleveland Golf, Woods HiBORETM Driver, "HiBORTM Driver—More Info," http://www.clevelandgolf.com/index.php?&&insidefile=club.html&oid=T010:2 wie3K, downloaded Sep. 21, 2006, 2 pages.

(Continued)

*Primary Examiner* — Alvin Hunter
(74) *Attorney, Agent, or Firm* — Klarquist Sparkman, LLP

(57) ABSTRACT

Described herein are embodiments of a golf club head having at least one rib with an external portion. For example, according to one embodiment, a wood-type golf club head includes a body that has at least one wall defining an interior cavity. The golf club head further includes at least one rib projecting from the at least one wall. The at least one rib can include an internal portion located within the interior cavity and an external portion located without the interior cavity.

19 Claims, 5 Drawing Sheets

U.S. PATENT DOCUMENTS

| | | | | |
|---|---|---|---|---|
| D338,935 | S | 8/1993 | Antonious | |
| 5,301,945 | A | 4/1994 | Schmidt et al. | |
| 5,318,297 | A | 6/1994 | Davis et al. | |
| 5,390,924 | A | 2/1995 | Antonious | |
| 5,419,559 | A | 5/1995 | Melanson et al. | |
| 5,429,354 | A | 7/1995 | Long et al. | |
| 5,435,558 | A | 7/1995 | Iriarte | |
| D363,100 | S | 10/1995 | Long et al. | |
| 5,470,069 | A | 11/1995 | Schmidt et al. | |
| 5,505,448 | A | 4/1996 | Park | |
| 5,518,242 | A | 5/1996 | Mahaffey et al. | |
| 5,669,828 | A | 9/1997 | Schmidt | |
| 5,941,782 | A | 8/1999 | Cook | |
| 5,944,620 | A | 8/1999 | Elmer | |
| D418,885 | S | 1/2000 | Wanchena | |
| 6,027,416 | A | 2/2000 | Schmidt et al. | |
| 6,139,446 | A | 10/2000 | Wanchena | |
| 6,248,026 | B1 | 6/2001 | Wanchena | |
| 6,319,148 | B1 | 11/2001 | Tom | |
| 6,595,871 | B2 | 7/2003 | Sano | |
| 6,645,087 | B2 | 11/2003 | Yabu | |
| 6,773,359 | B1 | 8/2004 | Lee | |
| 6,780,121 | B2 | 8/2004 | Herber | |
| 6,852,038 | B2 | 2/2005 | Yabu | |
| 6,878,073 | B2 | 4/2005 | Takeda | |
| 7,250,007 | B2 | 7/2007 | Lu | |
| 7,641,568 | B2 * | 1/2010 | Hoffman et al. | 473/327 |
| 7,887,433 | B2 * | 2/2011 | Hoffman et al. | 473/327 |
| 8,172,700 | B2 * | 5/2012 | Hoffman et al. | 473/332 |
| 2004/0087388 | A1 | 5/2004 | Beach et al. | |
| 2005/0209021 | A1 | 9/2005 | Hoffman et al. | |

OTHER PUBLICATIONS

Final Office action from the U.S. Patent and Trademark Office in U.S. Appl. No. 12/620,486 (dated Oct. 13, 2010).

Notice of Allowance from the U.S. Patent and Trademark Office in U.S. Appl. No. 11/565,485 (dated Sep. 25, 2009).

Notice of Allowance from the U.S. Patent and Trademark Office in U.S. Appl. No. 12/620,486 (dated Nov. 16, 2010).

Notice of Allowance from the U.S. Patent and Trademark Office in U.S. Appl. No. 13/020,753 (dated Jan. 13, 2012).

Office action from the U.S. Patent and Trademark Office in U.S. Appl. No. 11/565,485 (dated Feb. 25, 2008).

Office action from the U.S. Patent and Trademark Office in U.S. Appl. No. 11/565,485 (dated Sep. 19, 2008).

Office action from the U.S. Patent and Trademark Office in U.S. Appl. No. 11/565,485 (dated Feb. 13, 2009).

Office action from the U.S. Patent and Trademark Office in U.S. Appl. No. 12/620,486 (dated May 28, 2010).

Office action from the U.S. Patent and Trademark Office in U.S. Appl. No. 13/020,753 (dated Sep. 26, 2011).

* cited by examiner

GOLF CLUB HEAD HAVING RIBS

CROSS REFERENCE TO RELATED APPLICATION

The present application is a continuation of U.S. patent application Ser. No. 13/020,753, filed Feb. 3, 2011, now U.S. Pat. No. 8,172,700, which is a continuation of U.S. patent application Ser. No. 12/620,486, filed Nov. 17, 2009, now U.S. Pat. No. 7,887,433, which is a continuation of U.S. patent application Ser. No. 11/565,485, filed Nov. 30, 2006, which is now U.S. Pat. No. 7,641,568. These prior applications are incorporated herein by this reference.

FIELD

This application relates to a golf club head and more particularly, to a golf club head having ribs.

BACKGROUND

The acoustical properties of golf club heads, e.g., the sound a golf club head generates upon impact with a golf ball, affect the overall feel of a golf club by providing instant auditory feedback to the user of the club. For example, the auditory feedback can affect the feel of the club by providing an indication as to how well the golf ball was struck by the club, thereby promoting user confidence in the club and himself.

The sound generated by a golf club is based on the rate, or frequency, at which the golf club head vibrates upon impact with the golf ball. Generally, for wood-type golf clubs (as distinguished from iron-type golf clubs), particularly those made of steel or titanium alloys, a desired frequency is generally around 3,000 Hz and preferably greater than 3,200 Hz. A frequency less than 3,000 Hz may result in negative auditory feedback and thus a golf club with an undesirable feel.

In an effort to increase performance while complying with the industry-set standards and regulations, manufacturers of golf clubs commonly reconfigure golf club heads by adding various structures or features to the golf club head. For example, the body of a golf club head can be reconfigured to include a recessed portion to lower the volume of the golf club head, but maintain or increase performance of the head. Such structures or features, however, often result in an undesirable reduction in the vibration frequency of the golf club head and a negative auditory feedback. Attempts have been made to modify such club heads to correct the acoustic properties and vibrational responses of the club heads, often to the sacrifice of performance.

Accordingly, it would be desirable to increase the vibration frequencies of golf club heads having frequency reducing features in order to provide a golf club head that provides desirable feel through positive auditory feedback but without sacrificing the head's performance.

SUMMARY

Described herein are embodiments of a golf club head having at least one rib, extending from an external and/or internal portion of the head. For example, according to one embodiment, a wood-type golf club head can include a body that has at least one wall defining an interior cavity. The golf club head can also include at least one rib projecting inwardly and/or outwardly from the at least one wall. The at least one rib can include both an internal portion located within the interior cavity and an external portion located without the interior cavity. The body includes an internal surface and an external surface.

In some implementations, the external surface can define at least one concave portion and the external portion of the at least one rib can project from the concave portion.

In some implementations, the at least one rib and the body can be of unitary one-piece construction.

In some implementations, the internal portion of a rib can include at least a first internal portion and a second internal portion. In some such implementations, the external portion can be intermediate the first and second internal portions.

In some implementations, the body can include a front portion, rear portion, heel portion and toe portion. The at least one rib can extend from the front portion to the rear portion. In specific implementations, the body can include a ball impact plate that has a ball impact surface adjacent the front portion of the body. The at least one rib can extend generally perpendicular to the ball impact surface of the ball impact plate. In other specific implementations, the body can include a crown portion, a skirt portion and a sole portion. According to some embodiments, the at least one rib can project from at least the crown portion of the body. According to other embodiments, the at least one rib can project from at least the sole portion of the body. According to yet other aspects, the at least one rib can project from the crown portion, skirt portion and sole portion of the body.

In some implementations, the at least one rib can include at least three ribs.

The golf club head body can include a front portion, rear portion, heel portion and toe portion. In some implementations, the at least one rib can project from the toe portion. The body can include ball impact plate that has a ball impact surface adjacent the front portion of the body. In at least some implementations, the at least one rib can extend generally parallel to the ball impact surface of the ball impact plate. In other implementations, the at least one rib can extend generally parallel to the ball impact surface of the ball impact plate.

In another embodiment, a wood-type golf club head can include at least one wall that has an interior surface defining an interior cavity and an exterior surface opposite the interior surface. The exterior surface can have at least one recessed area. The golf club head can further include at least one rib that projects from the at least one wall and extends from the exterior surface outwardly away from the interior surface. At least a portion of the at least one rib can be positioned within the at least one recessed area.

In some implementations, the at least one rib extends from the interior surface inwardly toward the interior cavity.

In some implementations, the body can include a crown, skirt and sole, and wherein the at least one recessed area is positioned on the crown. In specific implementations, the at least one recessed area can include a first recessed area positioned on the crown and the body can include a second recessed area positioned on the sole. At least a portion of the at least one rib can be positioned within the first and second recessed areas.

In some implementations, the body can include a crown, skirt and sole and the at least one recessed area can be positioned on the sole.

In some implementations, the body can include a crown, skirt, sole, heel portion and toe portion generally opposite the heel portion and the at least one recessed area can be positioned on the toe portion.

In some implementations, the at least one rib can extend generally perpendicularly away from the at least one wall.

In some implementations, an overall resonant frequency of the club head that results from an impact with a golf ball can be at least approximately 3,000 Hertz.

In another embodiment, a wood-type golf club head can have a body that includes at least one wall that defines an interior cavity. The at least one wall can have an interior surface and an exterior surface. The golf club head can further include at least one rib that projects from the at least one wall. At least a portion of the rib can project outwardly from the exterior surface of the wall. The at least one rib is can be configured to increase the overall frequency of the club head that results from an impact with a golf ball. In some implementations, the at least one rib increases the overall frequency of the club head by at least 400 Hertz.

In some embodiments, the exterior surface can define at least one concave portion. The portion of the at least one rib can be positioned at least partially within the at least one concave portion. The portion can be an external portion and the rib can also include at least one internal portion projecting inwardly from the interior surface of the wall and positioned within the interior cavity.

The foregoing and other features and advantages of the golf club head will become more apparent from the following detailed description, which proceeds with reference to the accompanying figures.

DETAILED DESCRIPTION

Described below are several embodiments of a golf club head having at least one rib. The at least one rib can have an external portion and/or an internal portion and be positioned anywhere on the club head. In particular embodiments, the golf club head has an inverted area, e.g., a pocket, depression, or concave portion, on an external portion of the head. In specific implementations, the external portion of the at least one rib projects from and extends at least partially along or within the inverted area to improve properties, such as acoustical characteristics, of the golf club head upon impacting a golf ball.

Figure 1:
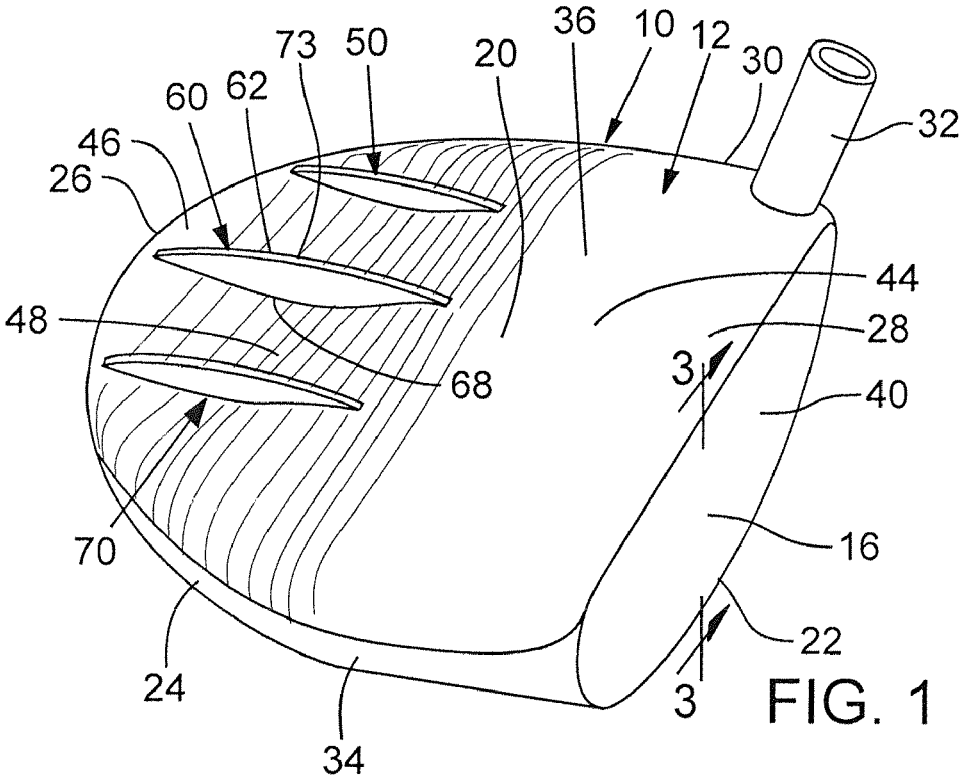
FIG. 1 is a top perspective view of one embodiment of a golf club head having a plurality of ribs each with an external portion proximate a crown of the golf club head and internal portions adjacent the external portion.
Figure 2:
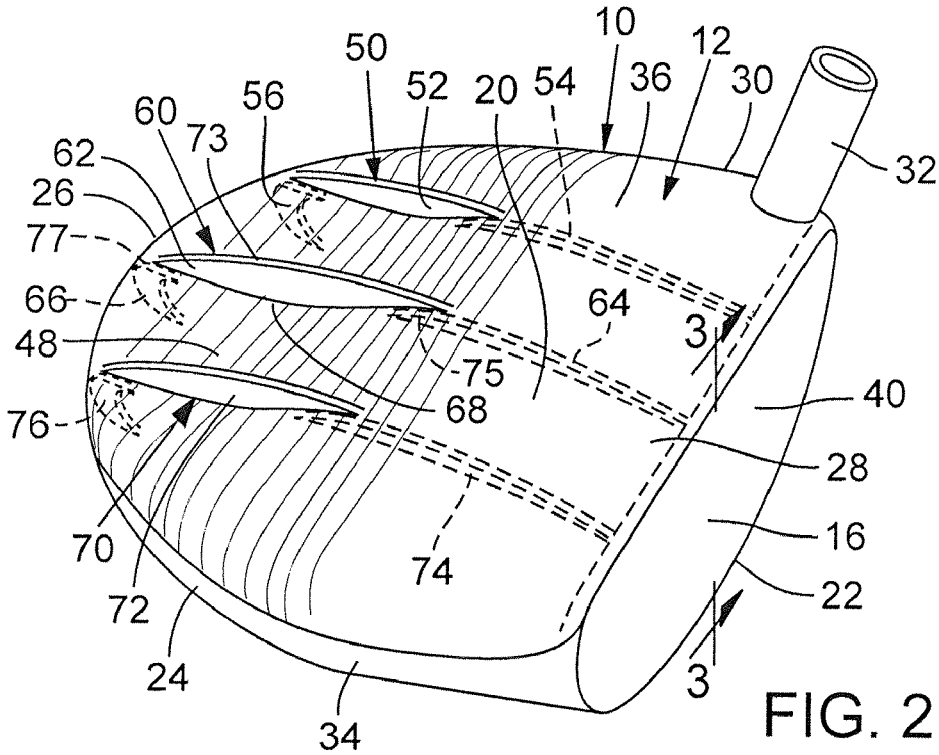
FIG. 2 is a top perspective view of the golf club head of FIG. 1 showing the internal portions of the ribs in dashed lines.
Figure 3:
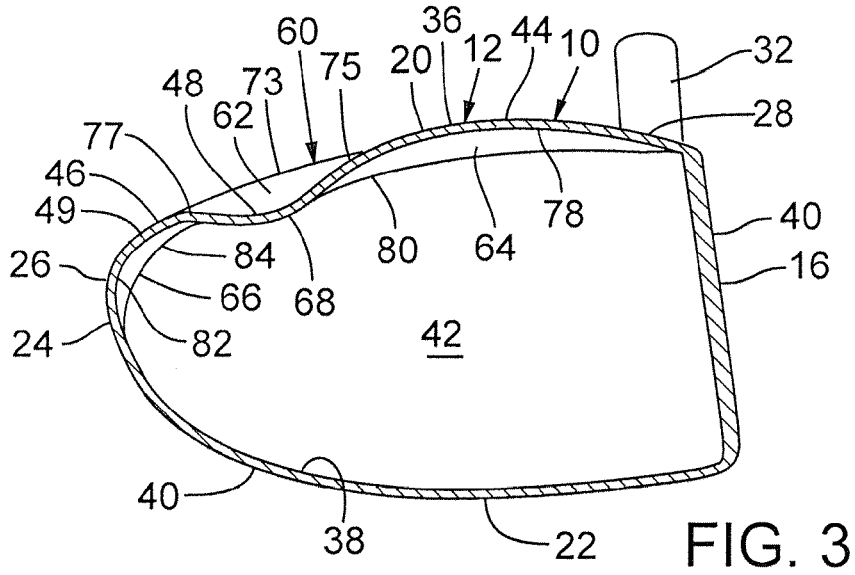
FIG. 3 is a vertical cross-sectional view of the golf club head of FIG. 1 taken along line 3-3 of FIGS. 1 and 2.

Referring to FIGS. 1-3, and according to one particular embodiment, a wood-type golf club head 10 is shown. The golf club head 10 includes a hollow body 12 that has a face plate, or ball impact plate, 16, crown 20, sole 22 and skirt 24. The body 12 includes an external surface 36 and an internal surface 38 (see, e.g., FIG. 3). Referring particularly to FIG. 3, an interior cavity 42 is defined by the internal surface 38 of the body 12 between the face plate 16, crown 20, sole 22 and skirt 24. The body 12 includes a rear portion 26, a front portion 28 generally opposite the rear portion, a heel portion 30 proximate a shaft, or shaft insert, 32 and a toe portion 34 generally opposite the heel portion.

The crown 20 can be described generally as the upper portion of the golf club head 10 rearwardly from the top of the face plate 16. The crown 20 can have any of various shapes and contours. In the specific embodiment shown in FIGS. 1-3, and with particular reference to FIG. 3, the crown 20 has two generally rounded convex portions 44, 46, adjacent, e.g., contiguous with, a generally rounded concave portion 48. As used herein, a convex portion is defined as a localized portion of the golf club head body having an external surface that curves, bulges, or otherwise projects generally outward away from the interior portion of the body. Likewise, a concave portion can be defined as a portion of the golf club head body having an external surface that curves, bulges or otherwise projects generally inward toward the interior portion of the body.

The concave portion 48 is positioned intermediate the convex portions 44, 46. The convex portion 44 extends from the front portion 28 proximate the top of the face plate 16 toward the rear portion 26 and forms a seamless transition with the concave portion 48. The convex portion 46 extends from the rear portion 26 toward the front portion 28 and forms a seamless transition with the concave portion 48. Although the concave portion can have any number of shapes and be oriented in any number of orientations, the concave portion 48 is shown positioned at least partially rearward of a midway point between the rear portion 26 and the front portion 28. The concave portion 48 also extends generally laterally across the crown 20 from the heel portion 30 to the toe portion 34 in a direction generally parallel to a striking surface 40 of the face plate 16.

Referring to FIG. 3, the body 12 of the club head 10 is thin-walled. The body 12 includes a wall 49 having an approximately uniform thickness defined between the external surface 36 and the internal surface 38. With the wall 49 having an approximately uniform thickness, the wall can be defined as being convexo-concave, i.e., the wall is convex on one side and concave on the opposite side. For example, the convex portions 44, 46 on the external surface of the body correspond with concave portions on the internal surface and the concave portion 48 on the external surface corresponds with a convex portion on the internal surface.

The sole 22 can be described generally as the lower portion of the golf club head 10 extending from a lowest point of the club head when the club head is at a proper address position and upwards a certain distance, such as, for example, approximately 15 mm for a typical driver and approximately 10-12 mm for a typically fairway wood.

The skirt 24 includes a side portion of the golf club head 10 between the crown 20 and the sole 22 that extends across a periphery of the golf club head, excluding the face plate, from the heel portion 30, along the rear portion 26, to the toe portion 34.

The golf club head 10 includes one or more ribs, such as ribs, 50, 60, 70. As used herein, a rib, can be defined generally as a structure having any of various shapes and sizes projecting or extending from any portion of the golf club head to provide structural support to, improved performance of, and/or acoustical enhancement of the golf club head. Ribs can be co-formed with, coupled to, secured to, or attached to, the golf club head. In more specific implementations, a rib includes a plate-like or thin-walled structure having a length substantially greater than its thickness. Each rib may have at least one external portion positioned on the external surface of a concave portion of the body of the golf club head. Additionally, in some embodiments, each rib may have at least one internal portion positioned on the internal surface of the body within the interior cavity.

In the illustrated embodiments, each rib comprises one or more internal portions aligned with and coupled to, via a wall of the body, one or more external portions. For example, referring to FIGS. 1 and 2, ribs 50, 60, 70 each include an external portion 52, 62, 72, respectively, and two internal portions, i.e., a first internal portion 54, 64, 74, respectively, and a second internal portion 56, 66, 76, respectively. Referring to rib 60, with ribs 50, 70 having similar features, the external portion 62 and internal portions 64, 66 of the rib 60 include a fixed edge coupled directly to and adjoining the wall 49 of the body 12 and a free edge facing away from the wall. For example, the external portion 62 projects from the external surface 36 of the concave portion 48 of the body 12 at a fixed edge 68 and terminates at a free edge 73. The first and second internal portions 64, 66 project from the internal surface 38 of respective convex portions 44, 46 of the body at respective fixed edges 78, 82, and terminate at respective free edges 80, 84 (see FIG. 3).

As shown, the external portion of the ribs, such as external portion 62 of rib 60, are positioned at least partially within and extend generally perpendicularly away from the external surface 36 of the concave portion 48 of the body 12. The fixed edge 68 is contoured to follow the contour of the external surface 36 of the concave portion 48 and the free edge 73 can have any of various contours. For example, as shown, the free edge 73 follows the same general contour as, e.g., is generally flush with, the external surface 36 of the convex portions 44, 46 of the crown 20.

Similar to the external portion 62, the first and second internal portions 64, 66 are positioned at least partially within and extend generally perpendicularly away from the internal surface 38 of the convex portions 44, 46, respectively, of the body 12. The fixed edges 78, 82 are contoured to follow the contour of the internal surface 38 of the respective convex portions 44, 46, which, in embodiments having a generally convexo-concave club head body wall, has a generally concave contour. The free edges 80, 84 of the respective first and second internal portions 64, 66 have the same general contour as the internal surface 38 from which the internal portions extend. In other implementations, the free edges of the ribs can have any of various contours.

Referring to FIG. 3, the second internal portion 66 of the rib 60 is configured, e.g., has a length, such that a portion of the second internal portion of the rib also projects from the internal surface 38 of at least a portion of the skirt 24 of the body 12.

The first and second internal portions 64, 66 of rib 60 are coupled to the external portion 62 via first and second rib transition regions 75, 77 formed in the wall 49 of the body 12. The first transition region 75 includes the portion of the wall 49 between the first internal portion 64 and the external portion 62 and the second transition region 77 includes the portion of the wall 49 between the second internal portion 66 and the external portion. As described above, the external portion 62 and the first and second internal portions 64, 66 are in alignment with each other, e.g., collinear, and parallel to each other. Accordingly, the rib 60 can be described as one continuous and monolithic rib extending from the first and second internal portions 64, 66 to the external portion 62 via the first and second transition regions 75, 77.

Although the portions of the ribs shown in the illustrated embodiments extend generally perpendicularly away from the external and internal surfaces of the body, in some embodiments, the portions of the ribs can be angled, i.e., form a minor angle that is less than ninety degrees or a major angle that is greater than ninety degrees, with respect to a respective external or internal surface.

Although not required in all embodiments, in the illustrated embodiment shown in FIGS. 1-3, the ribs 50, 60, 70 extend generally transversely away from the face plate striking surface 40 of the face plate 16 and generally parallel to each other. In other embodiments, one or more ribs can extend transversely away from the face plate striking surface and one or more ribs can extend at a minor angle less than ninety degrees and a major angle greater than ninety degrees relative to the face plate striking surface. Further, although the ribs 50, 60, 70 of the illustrated embodiment shown in FIGS. 1-3 are spaced-apart on the crown an equal distance apart form each other, in other embodiments, the ribs can be spaced at different distances apart from each other. Also, golf club head 10 has three ribs. However, in other embodiments, a golf club head can have more or less than three ribs.

The ribs of the present disclosure are lightweight and compact. By way of example only, in specific implementations, each rib, such as ribs 50, 60, 70, of the golf club head, such as head 10, can have a rib mass of approximately 7 grams and a rib thickness of approximately 0.8 mm. Of course, in other implementations, the particular dimensions of the ribs may vary, and optimal dimensions may be different for different head designs.

Preferably, the overall frequency of the golf club head, i.e., the average of the first mode frequencies of the crown, sole and skirt portions of the golf club head, generated upon impact with a golf ball is greater than 3,000 Hz. Frequencies above 3,000 Hz provide a user of the golf club with an enhanced feel and satisfactory auditory feedback. However, a golf, club head having a concave portion or portions, which in some instances are advantageous for reducing the overall volume of the golf club head, can reduce the first mode vibration frequencies to undesirable levels. The addition of ribs having an external portion positioned along at least a portion of the concave portion(s) can significantly increase the first mode vibration frequencies, thus allowing the first mode frequencies to approach a more desirable level and improving the feel of the golf club to a user. Moreover, the addition of ribs having one or more internal portions in addition to the one or more external portions, can increase the first mode frequencies even more.

For example, four golf club head designs were modeled using commercially available computer aided modeling and meshing software, such as Pro/Engineer by Parametric Technology Corporation for modeling and Hypermesh by Altair Engineering for meshing. The golf club head designs were analyzed using finite element analysis (FEA) software, such as the finite element analysis features available with many commercially available computer aided design and modeling software programs, or stand-alone FEA software, such as the ABAQUS software suite by ABAQUS, Inc.

The first golf club head design was made of titanium and shaped similar to the head shown in FIGS. 1-3, but did not have ribs projecting from the wall of the golf club head body. The second golf club head design had a golf club head similar to the first design, but included the specific implementation of ribs shown in FIGS. 1-3 and discussed above. In other words, the second golf club head design had three ribs each having an external portion positioned within the concave portion of the golf club head crown, two internal portions adjacent the external portion, a mass of approximately 7 grams, and a thickness of approximately 0.8 mm. The third golf club head design had a golf club head similar to the second design, but each rib included only an external portion and no internal portions. Finally, the fourth golf club head design had a golf club head similar to the second design, but each rib included only internal portions and no external portion.

Referring to Table 1 below, the predicted first or normal mode frequency of the golf club head crown, i.e., the frequency at which the crown will oscillate when the golf club head impacts a golf ball, was obtained using FEA software for the various golf club head designs and is shown. The frequency increase and percent frequency increase of the second, third, and fourth designs over the first design are also shown.

TABLE 1

| | 1st Design | 2nd Design | 3rd Design | 4th Design |
|---|---|---|---|---|
| Frequency (Hz) | 1,387 | 3,511 | 3,360 | 1,567 |
| Frequency Increase (Hz) | 0 | 2,124 | 1,973 | 180 |
| Percent Increase | 0% | 153% | 142% | 13% |

As shown in Table 1, the predicted first mode frequency of the golf club head crown for the first design is well below the preferred lower limit of 3,000 Hz. By adding three ribs each having an external portion and two internal portions, the predicted first mode frequency of the golf club head crown is approximately 3,511 Hz, which is a 153% increase in frequency over the first golf club head design and within a more desirable frequency range. Similarly, the predicted first mode frequency of the golf club head crown for the third golf club head design with ribs having only external portions is approximately 3,360 Hz, which is a 142% increase in frequency over the first golf club head design and within a more desirable frequency range. Finally, by taking away the external portions of the ribs such that the ribs have only internal portions, the first mode frequency of the fourth golf club head design is approximately 1,567 Hz, which is only a 13% increase over the first golf club head design and significantly lower than the preferred lower limit.

Based on the results of the analysis, the impact of having ribs with external portions on the first mode frequency is quite significant. More specifically, ribs that have external portions within a concave portion of the golf club head crown, while increasing the mass of the head by a small amount, e.g., approximately 21 grams, increase the predicted frequency of the first mode frequency of the golf club head crown by at least 142%.

The golf club head 10 shown in FIGS. 1-3 and the associated ribs 50, 60, 70 having external and internal portions are merely exemplary of one specific golf club head configuration. In other embodiments, any of various golf club head and rib configurations can be used.

Figure 4:
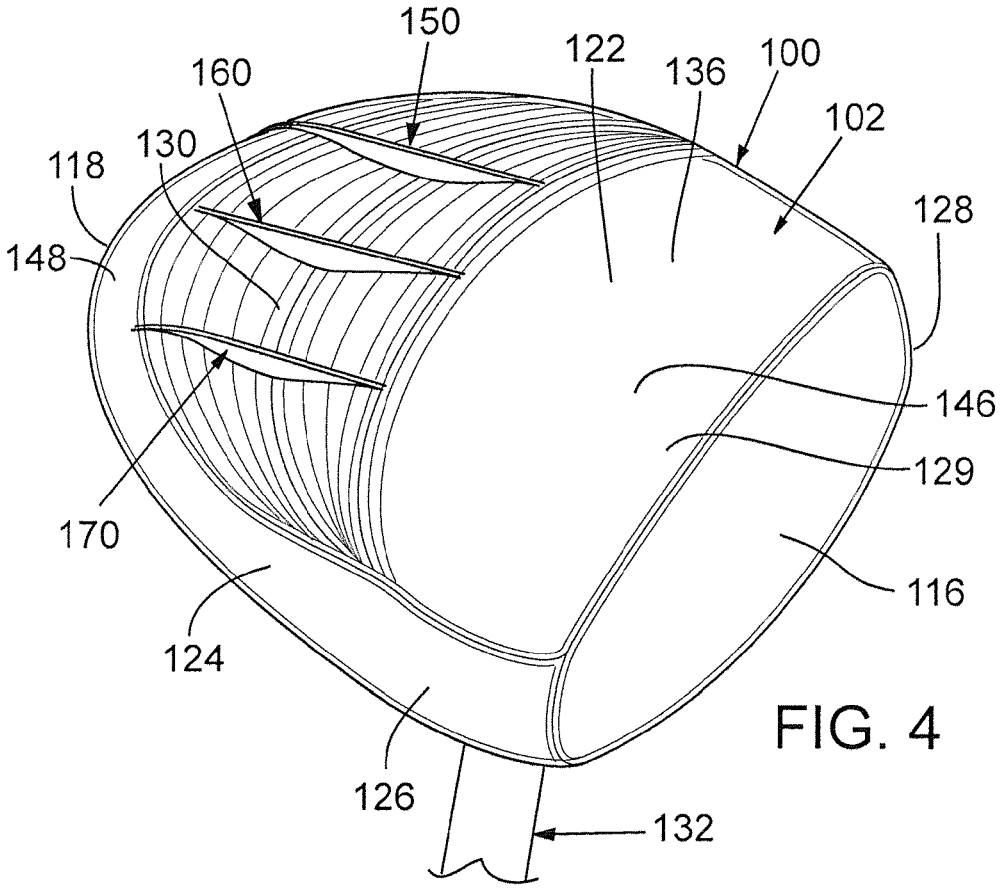
FIG. 4 is a bottom perspective view of a second embodiment of a golf club head having a plurality of ribs each with an external portion proximate a sole of the golf club head and internal portions adjacent the external portion.
Figure 5:
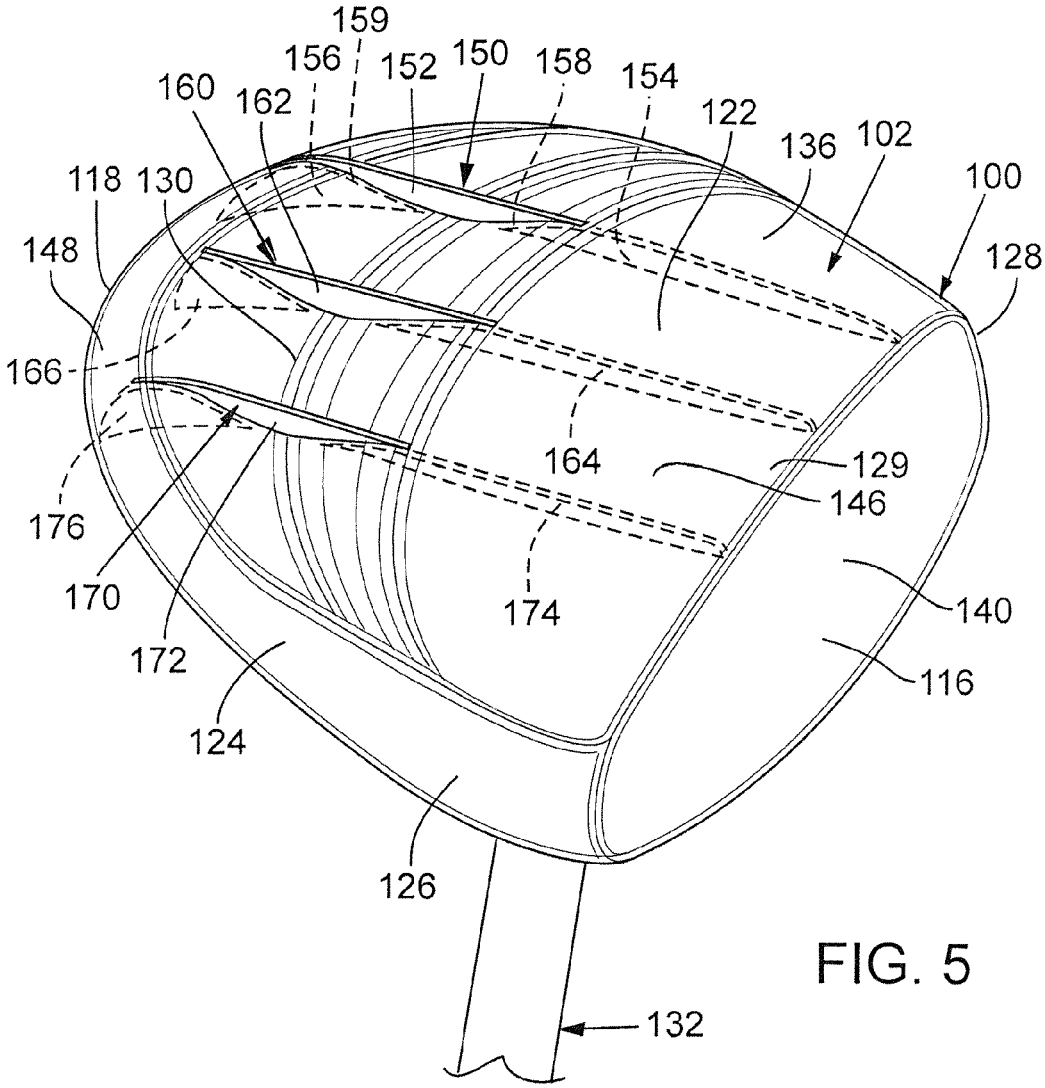
FIG. 5 is a bottom perspective view of the golf club head of FIG. 4 showing the internal portions of the ribs in dashed lines.

For example, as shown in FIGS. 4 and 5, in one alternative embodiment, golf club head 100 includes a body 102 having concave portion 130 formed in an external surface 136 of a sole 122 of the body. Similar to the crown 20 of golf club head 10 described above, the sole 122 includes two generally rounded convex portions 146, 148 contiguous with the concave portion 130. The concave portion 130 is located rearward of a midpoint of the sole 122, i.e., closer to a rear portion 118 of the body 102 than a front portion 129. The concave portion 130 extends generally laterally across the sole 122 from a heel portion 126 proximate a shaft, or shaft insert, 132 to a toe portion 128. Although the concave portion 130 shown is located rearward of the midpoint of the sole, in other embodiments, a concave portion can be located in any position along the sole.

Similar to ribs 50, 60, 70 described above, the golf club head 100 includes ribs 150, 160, 170 each having an external portion, such as external portion 152, 162, 172 of ribs 150, 160, 170, respectively, positioned along and extending from the concave portion 130. Referring to FIG. 5, ribs 150, 160, 170 include a first internal portion 154, 164, 174 and a second internal portion 156, 166, 176 each projecting from an internal surface of the body 102. The first internal portions 154, 164, 174 extend rearward from a location on the internal surface of the sole 122 proximate the front 129 of the body 102 to the concave portion 130 and the second internal portions 156, 166, 176 extend rearward and upward from the concave portion 130 to a location on the internal surface of a skirt 124 of the body 102. Generally, the ribs 50, 60, 70 extend generally transversely away from a striking surface 140 of face plate 116.

Referring to rib 150, it being exemplary of ribs 160, 170, the external portion 152 is collinear with and positioned between the first and second internal portions 154, 156. The external portion 152 is coupled to the internal portions 154, 156 via respective first and second rib transition regions 158, 159 formed in a wall of the body 102.

By way of example only, in specific implementations, each rib of the golf club head, such as ribs 150, 160, 170 of golf club head 100, can have a rib mass of approximately 5 grams and a rib thickness of approximately 0.8 mm. Of course, in other implementations, the particular dimensions of the ribs may vary, and optimal dimensions may be different for different head designs.

Similar to the analysis discussed above, four golf club head designs similar to the embodiment shown in FIGS. 4 and 5 were modeled using computer aided modeling, meshing, and FEA software. Like the above analysis, the first golf club head design did not have ribs, the second golf club head design had ribs with both internal and external portions, the third golf club head design had ribs with only external portions, and the fourth golf club head design had ribs with only internal portions. The golf club head was made of titanium and the ribs of the second golf club head design had a mass of approximately 5 grams and thickness of approximately 0.8 mm.

Similar to Table 1 above, Table 2 below includes the predicted first mode frequency of the golf club head sole obtained using FEA software for the various golf club head designs based on the embodiment shown in FIGS. 4 and 5.

TABLE 2

| | 1st Design | 2nd Design | 3rd Design | 4th Design |
|---|---|---|---|---|
| Frequency (Hz) | 1,677 | 2,953 | 2,467 | 2,236 |
| Frequency Increase (Hz) | 0 | 1,276 | 790 | 559 |
| Percent Increase | 0% | 76% | 47% | 33% |

As shown in Table 2, the predicted first mode frequency of the golf club head sole for the first design is well below the preferred lower limit of 3,000 Hz. By adding three ribs each having an external portion and two internal portions, the predicted first mode frequency of the golf club head sole is approximately 2,953 Hz, which is a 76% increase in frequency over the first golf club head design or the golf club head without ribs. Similarly, the predicted first mode frequency of the golf club head sole for the third golf club head design with ribs having only external portions is approximately 2,467 Hz, which is a 47% increase in frequency over the first golf club head design. Finally, by taking away the external portions of the ribs such that the ribs only have internal portions, the first mode frequency of the fourth golf club head design is approximately 2,236 Hz, which is a 33% increase over the first golf club head design but below the preferred lower limit.

Based on the results of the analysis, the impact of having ribs with external portions on the first mode frequency is quite significant. More specifically, ribs that have external portions within a concave portion of the golf club head crown, while increasing the mass of the head by a small amount, e.g., approximately 15 grams, increase the predicted frequency of the first mode frequency of the golf club head crown by at least 47%.

Figure 6:
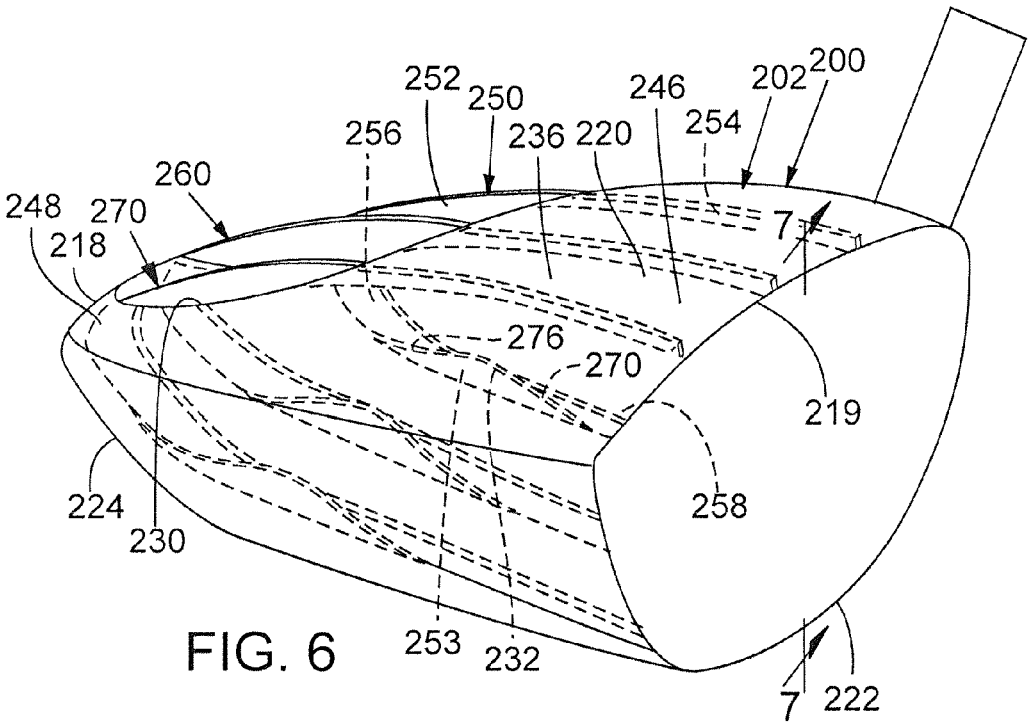
FIG. 6 is a top perspective view of a third embodiment of a golf club head having a plurality of ribs each with external portions proximate a crown and sole of the golf club head, respectively, and internal portions adjacent respective external portions.
Figure 7:
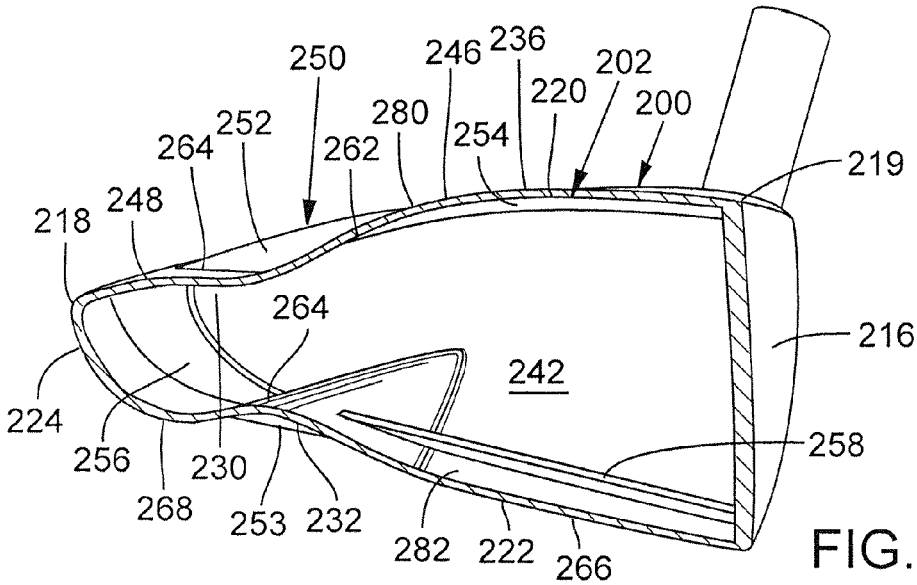
FIG. 7 is a vertical cross-sectional view of the golf club head of FIG. 6 taken along line 7-7 of FIG. 6.

As shown in FIGS. 6 and 7, and according to another embodiment, golf club head 200 includes a body 202 having an external surface 236 and an internal surface 282. The body 202 includes a first concave portion 230 formed in the external surface 236 of a crown 220 of the body and a second concave portion 232 formed in an external surface of a sole 222 of the body. Similar to the crown 20 of golf club head 10 described above, the crown 220 includes two generally rounded convex portions 246, 248 contiguous with the first concave portion 230. Also, similar to the sole 122 of golf club head 100 described above, the sole 222 include two generally rounded convex portions 266, 268 contiguous with the concave portion 232. Both concave portions 230, 232 are located closer to a rear portion 218 of the body 202 than a front portion 219 of the body.

The club head 200 includes ribs 250, 260, 270, which are similar to the ribs described above, except that each rib has multiple external portions and extends continuously along the crown 220, skirt 224, and sole 222 of the golf club head. More specifically, rib 250, it being exemplary of ribs 260, 270, includes a first external portion 252 positioned along and projecting from the first concave portion 230 and a second external portion 253 positioned along and projecting from the second concave portion 232.

The rib 250 also includes a first internal portion 254, a second internal portion 256, and a third internal portion 258 each projecting from the internal surface 282 of the body 202. The first internal portion 254 extends rearward from a location on the internal surface 282 of the crown 220 proximate a front portion 219 of the body 202 to the first concave portion 230. The second internal portion 256 extends rearward from the first concave portion 230 along the internal surface 282 of the crown 220, downward along the internal surface of the skirt 224, and forward along the internal surface of the sole 222 to the second concave portion 232. The third internal portion 258 extends forward from the second concave portion 232 along the internal surface 282 of the sole 222 to a location on the internal surface of the sole proximate the front portion 219 of the body 202.

The first external portion 252 is collinear with and positioned between the first and second internal portions 254, 256 and coupled to the internal portions via respective first and second rib transition regions 262, 264 formed in a wall 280 of the body 202. Similarly, the second external portion 253 is positioned between the second and third internal portions 256, 258 and coupled to the internal portions via third and fourth rib transition regions 276, 278.

By way of example only, in specific implementations, each rib of the golf club head, such as ribs 250, 260, 270 of golf club head 200, can have a rib mass of approximately 9 grams and a rib thickness of approximately 0.8 mm. Of course, in other implementations, the particular dimensions of the ribs may vary, and optimal dimensions may be different for different head designs.

As with previous embodiments, four golf club head designs similar to the embodiment shown in FIGS. 6 and 7 were modeled using computer aided modeling, meshing, and FEA software. The first golf club head design did not have ribs, the second golf club head design had ribs with both internal and external portions, the third golf club head design had ribs with only external portions, and the fourth design had ribs with only internal portions. The golf club head was made of titanium and the ribs of the second golf club head design had a mass of approximately 9 grams and thickness of approximately 0.8 mm.

The predicted first mode frequency of the golf club head crown (see Table 3) and sole (see Table 4) obtained using FEA software for the various golf club head designs are shown.

TABLE 3

| | 1st Design | 2nd Design | 3rd Design | 4th Design |
|---|---|---|---|---|
| Crown Frequency (Hz) | 1,083 | 2,809 | 2,417 | 2,415 |
| Frequency Increase (Hz) | 0 | 1,726 | 1,334 | 1,332 |
| Percent Increase | 0% | 160% | 123% | 123% |

TABLE 4

| | 1st Design | 2nd Design | 3rd Design | 4th Design |
|---|---|---|---|---|
| Sole Frequency (Hz) | 1,483 | 2,809 | 2,417 | 2,207 |
| Frequency Increase (Hz) | 0 | 1,326 | 934 | 724 |
| Percent Increase | 0% | 89% | 63% | 49% |

As shown in Tables 3 and 4, the predicted first mode frequency of the golf club head crown and sole for the first design is well below the preferred lower limit of 3,000 Hz. By adding three ribs each having two external portions and three internal portions, the predicted first mode frequency of the golf club head crown and sole is approximately 2,809 Hz, which is a 160% increase in crown frequency and an 89% increase in sole frequency over the first golf club head design. Similarly, the predicted first mode frequency of the golf club head crown and sole for the third golf club head design with ribs having only external portions is approximately 2,417 Hz, which is a 123% increase in crown frequency and a 63% increase in sole frequency over the first golf club head design. Finally, by taking away the external portions of the ribs such that the ribs only have internal portions, the crown frequency of the fourth golf club head design is approximately 2,415 Hz, which is a 33% increase over the first golf club head design, and the sole frequency of the fourth golf club head design is approximately 2,207 Hz, which is a 49% increase over the first golf club head design.

Based on the results of the analysis, the impact of having ribs with external portions on the first mode frequency of the crown and sole is quite significant. Accordingly, ribs that have two external portions within respective concave portions on the golf club head crown and sole, while increasing the mass of the head by a small amount, e.g., approximately 27 grams, increase the predicted frequency of the crown frequency by at least 123% and the sole frequency by at least 63%.

Figure 8:
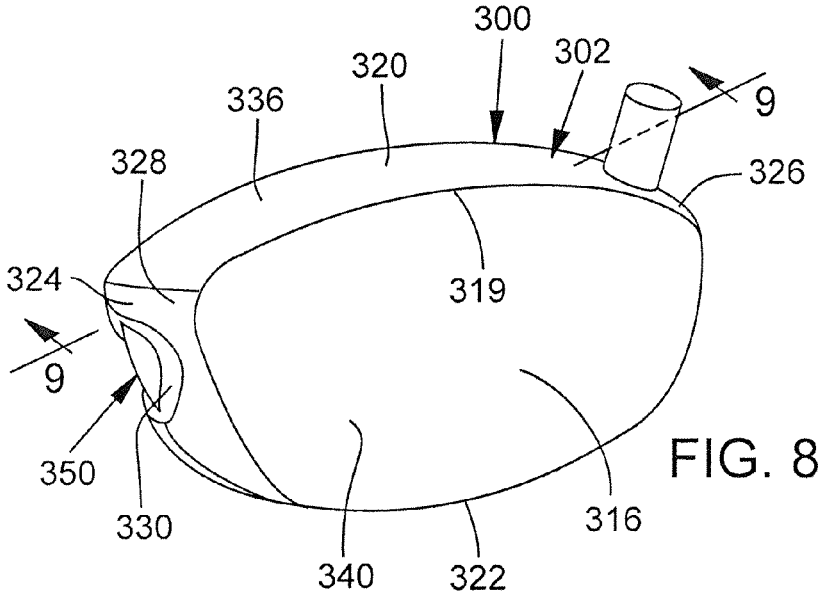
FIG. 8 is a frontal perspective view of a fourth embodiment of a golf club head having a rib with an external portion proximate a toe of the golf club head and internal portions adjacent the external portion.
Figure 9:
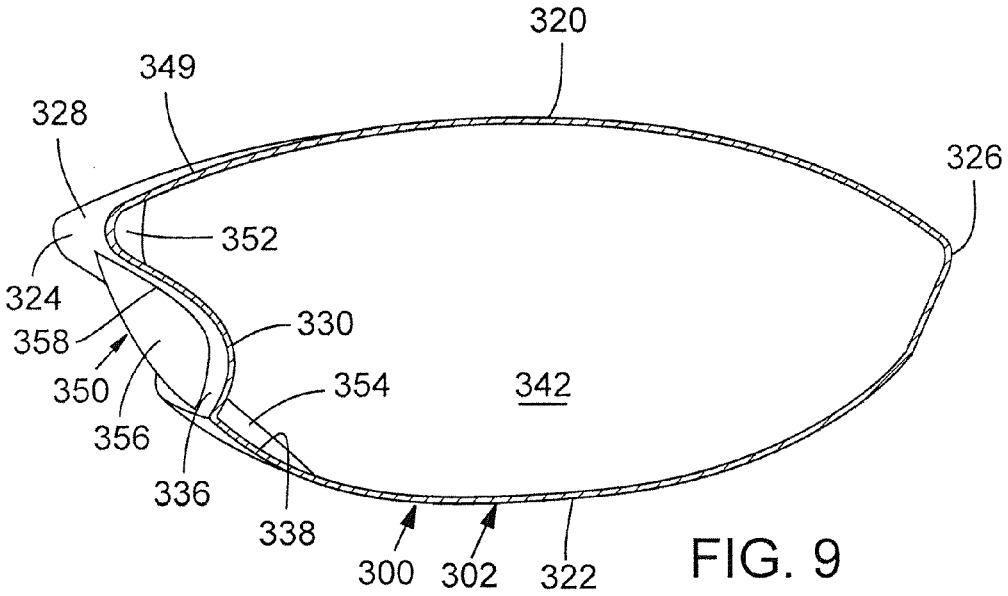
FIG. 9 is a vertical cross-sectional view of the golf club head of FIG. 8 taken along line 9-9 of FIG. 8.

Referring now to FIGS. 8 and 9, another embodiment of a golf club head having a rib with an external portion positioned along a concave portion of the head is shown. Golf club head 300 includes a body 302 that has a concave portion 330 formed in an external surface 336 of a skirt 324 of the body proximate a toe portion 328 of the body.

The golf club head 300 includes a rib 350 that has an external portion 356 and two internal portions 352, 354. The external portion is positioned along and projects from the external surface 336 of the concave portion 330. The internal portions 352, 354 are positioned within an internal cavity 342 of the body 302 and projects from an internal surface 338 of the body. Unlike the ribs previously shown, rib 350 extends generally parallel to a striking surface 340 of a face plate 316 of the golf club head 300 along the toe portion 328 of the body 302. More specifically, the rib 350 extends along the toe potion 328 of the body 302 upwardly from a sole 322 of the body 302, along the skirt 324, to a crown 320 of the body.

The external portion 356 is positioned between the first and second internal portions 352, 354 and is coupled to the internal portions via respective first and second rib transition regions (not shown) formed in a wall 349 of the body 102.

Although the golf club head 300 shown includes only one rib 350 projecting from a concave portion 330 formed in the toe portion 328, in other embodiments, more than one rib can be project from the concave portion 330 and be parallel to or angled with respect to each other.

As with previous embodiments, four golf club head designs similar to the embodiment shown in FIGS. 8 and 9 were modeled using computer aided modeling, meshing, and FEA software. The first golf club head design did not have a rib, the second golf club head design had a rib with both internal and external portions, the third golf club head design had a rib with only external portions, and the fourth design had a rib with only internal portions. The golf club head was made of titanium and the rib of the second golf club head design had a mass of approximately 1 gram and thickness of approximately 0.8 mm.

The predicted first mode frequency of the golf club head toe obtained using FEA software for the various golf club head designs are shown in Table 5.

TABLE 5

| | 1st Design | 2nd Design | 3rd Design | 4th Design |
|---|---|---|---|---|
| Frequency (Hz) | 2,478 | 3,358 | 3,335 | 2,574 |
| Frequency Increase (Hz) | 0 | 880 | 857 | 96 |
| Percent Increase | 0% | 36% | 35% | 4% |

As shown in Table 5, the predicted first mode frequency of the golf club head toe for the first design is 2,478 Hz, which is below the preferred lower limit of 3,000 Hz. By adding a single rib that has an external portion and two internal portions, the predicted first mode frequency of the golf club head toe is approximately 3,358 Hz, which is a 36% increase in frequency over the first golf club head design or the golf club head without ribs and is above the lower limit. Similarly, the predicted first mode frequency of the golf club head toe for the third golf club head design with a rib having only external portions is approximately 3,335 Hz, which is a 35% increase in frequency over the first golf club head design. Finally, by taking away the external portions of the ribs such that the rib only has internal portions, the first mode frequency of the fourth golf club head design is approximately 2,574 Hz, which is a 4% increase over the first golf club head design.

Based on the results of the analysis, the impact of having a rib with an external portion on the first mode frequency is significant. Accordingly, a rib that has an external portion within a concave portion of the golf club head toe, while increasing the mass of the head by only 1 gram, increases the predicted frequency of the first mode frequency of the golf club head toe by at least 35%.

Actual or cosmetic physical embodiments of the modeled embodiments were made and tested to substantiate the predicted first mode frequency values obtained using FEA analysis. As the modeled embodiments were simplified models, the testing of the physical embodiments resulted in frequency measurements approximately 200-400 Hz greater than the frequencies obtained using FEA analysis. Accordingly, the first mode frequencies for the physical embodiments of the second golf club head designs, i.e., golf club heads including one or more ribs each with an external portion in a concave portion formed in the head and internal portions coupled to the external portion, exceeded the preferred lower limit of 3,000 Hz, and in some embodiments, exceeded a frequency of 3,500 Hz.

In addition to the effects on the acoustical properties of a golf club head, the ribs as described herein can provide additional advantages. For example, ribs having external portions can improve the consistency of the golf club head by providing a stabilizing effect as the club travels through or contacts the ground. Further, the ribs can increase the overall stiffness of the golf club head, which not only impacts the acoustical properties of the golf club head, but can improve the performance of the golf club head. Additionally, the ribs can provide increased dent resistance of the golf club head by structurally reinforcing the head.

In certain implementations, the crown, sole, skirt and ribs of the above embodiments can be integrally formed using techniques such casting or forging.

In other implementations, the golf club head body of the above embodiments can be formed using casting or forging techniques, and the ribs can be secured to the body using other coupling techniques, such as welding, adhering, or fastening the ribs to the golf club head body. For example, in certain implementations, at least one of the ribs is formed separate from the body of the head and made of a one-piece monolithic construction. Such a rib can be termed a unitary rib and include an elongate plate-like element. The unitary rib can be coupled to, rather than being formed as a one-piece construction with, the body of the golf club head. In other words, in one specific implementation, slots are formed in or cut into at least a portion of respective concave and convex portions of the golf club head body. The slots are sized and shaped to receive a unitary rib therein. The unitary rib can be secured to and at least partially within the slots using conventional coupling techniques described above.

Although the concave portions shown in the illustrated embodiments have generally curved or rounded, and smooth contours, in some embodiments, the concave portions can have contours with a shape other than round and a surface finish other than smooth. For example, in specific implementations, the concave portion can have sharp angles or corners, such as a recessed pocket or depression.

Additionally, although the golf club heads of the illustrated embodiments have ribs with external portions and internal portions, in some embodiments, a golf club head can have one or more ribs with only internal portions or one or more ribs with only external portions and provide the same or similar advantages over conventional golf club heads as described above. For example, a golf club head can have ribs similar to ribs 50, 60, 70 of golf club head 10 except the head is formed without internal portions such that ribs 50, 60, 70 have only have external portions 52, 62, 72. Conversely, in some embodiments, a golf club head can be similar to golf club head 10 except the external portions 52, 62, 72 of the ribs 50, 60, 70 are not formed such that the ribs 50, 60, 70 have only internal portions.

Further, although the golf club heads of the illustrated embodiments have at least one concave portion on an external surface of the golf club head, in other embodiments, the golf club head does not have a concave portion. In such embodiments, for example, the golf club head can have at least one rib with one or more external portions projecting from a convex portion on the external surface of the golf club head.

In view of the many possible embodiments to which the principles of the disclosed golf club head may be applied, it should be recognized that the illustrated embodiments are only preferred examples of the golf club head and should not be taken as limiting the scope of the invention. Rather, the scope of the invention is defined by the following claims. We therefore claim as our invention all golf club heads that come within the scope and spirit of these claims.

We claim:

1. A wood-type golf club head, comprising:

a body comprising at least one of a crown portion, a sole portion and a skirt portion, the body defining an interior cavity; and at least one rib projecting from one or more of the crown portion, the sole portion and the skirt portion, the at least one rib comprising an internal portion located within the interior cavity and an external portion located outside of the interior cavity, the internal portion of the at least one rib comprises at least a first internal portion located entirely within the interior cavity and the external portion having a region being located only entirely outside of the interior cavity, wherein the body comprises an internal surface and an external surface, the external surface defining at least one curved portion, and wherein the external portion of the at least one rib projects from the curved portion.

2. The wood-type golf club head of claim 1, wherein the curved portion is a concave portion, and wherein the external portion of the at least one rib projects from the concave portion.

3. The wood-type golf club head of claim 1, wherein the at least one rib and the body comprise a unitary one-piece construction.

4. The wood-type golf club head of claim 1, wherein the body further comprises a front portion, rear portion, heel portion and toe portion, and wherein the at least one rib extends from the front portion to the rear portion.

5. The wood-type golf club head of claim 4, wherein the body comprises a ball impact plate having a ball impact surface adjacent the front portion of the body, and wherein the at least one rib extends generally perpendicular to the ball impact surface of the ball impact plate.

6. The wood-type golf club head of claim 5, wherein the at least one rib extends along at least the crown portion of the body.

7. The wood-type golf club head of claim 5, wherein the at least one rib extends along at least the sole portion of the body.

8. The wood-type golf club head of claim 5, wherein the at least one rib extends along the crown portion, skirt portion and sole portion of the body.

9. The wood-type golf club head of claim 1, wherein the external portion is separated from the first internal portion by a first transition region.

10. The wood-type golf club head of claim 1, wherein the body comprises a front portion, rear portion, heel portion and toe portion, and wherein the at least one rib extends along the toe portion.

11. The wood-type golf club head of claim 10, wherein the body comprises a ball impact plate having a ball impact surface adjacent the front portion of the body, and wherein the at least one rib extends generally parallel to the ball impact surface of the ball impact plate.

12. A wood-type golf club head, comprising:

a body comprising at least one of a crown portion, a sole portion and a skirt portion and having an interior surface defining an interior cavity and an exterior surface opposite the interior surface, the exterior surface having at least one recessed area; and at least one rib projecting from one or more of the crown portion, the sole portion and the skirt portion and extending from the exterior surface outwardly away from the interior surface, wherein at least one external portion of the at least one rib is positioned within the at least one recessed area and an internal portion of the at least one rib is positioned within an interior cavity and extending from the interior surface inwardly away from the exterior surface toward the interior cavity, wherein each exterior portion positioned within the recessed area defines a curved profile smoothly adjoined with adjacent external surface areas.

13. The wood-type golf club head of claim 12, wherein the at least one recessed area is positioned on the crown portion.

14. The wood-type golf club head of claim 13, wherein the at least one recessed area comprises a first recessed area, the body further comprising a second recessed area positioned on the sole portion, wherein at least a portion of the at least one rib is positioned within the first and second recessed areas.

15. The wood-type golf club head of claim 12, wherein the at least one recessed area is positioned on the sole portion.

16. The wood-type golf club head of claim 12, wherein the body comprises a heel portion and a toe portion generally opposite the heel portion, and wherein the at least one recessed area is positioned on the toe portion.

17. The wood-type golf club head of claim 12, wherein the at least one rib extends generally perpendicularly away from the at least one wall.

18. The wood-type golf club head of claim 12, wherein the at least one rib increases the overall frequency of the club head resulting from impact with a golf ball by at least 400 Hertz.

19. The wood-type golf club head of claim 12, wherein the at least one recessed portion is at least one concave portion, and wherein the portion of the at least one rib is positioned at least partially within the at least one concave portion.

* * * * *